US005247182A

United States Patent [19]

Servant et al.

[11] Patent Number: 5,247,182

[45] Date of Patent: Sep. 21, 1993

[54] CLOTHING FOR PROTECTION OF GONADAL REGION

[76] Inventors: Raymond H. Servant, 2919 Appleton Ct., Oakville, Ontario, Canada, L6J 6S5; Martin J. Lilley, 445 St. Clements Ave., Toronto, Ontario, Canada, M5N 1M2

[21] Appl. No.: 767,217

[22] Filed: Sep. 30, 1991

[30] Foreign Application Priority Data

Oct. 2, 1990 [GB] United Kingdom ..... 9021363

[51] Int. Cl.[5] ..... G21F 3/02

[52] U.S. Cl. ..... 250/516.1; 250/519.1

[58] Field of Search ..... 250/516.1, 515.1, 519.1

[56] References Cited

U.S. PATENT DOCUMENTS

| | | | |
|---|---|---|---|
| 3,310,053 | 3/1967 | Greenwood | 250/516.1 |
| 3,996,620 | 12/1976 | Maine | 2/2 |
| 4,196,355 | 4/1980 | Maine | 250/516.1 |
| 4,938,233 | 7/1990 | Orrison, Jr. | 128/849 |

FOREIGN PATENT DOCUMENTS

| | | | |
|---|---|---|---|
| 0371699 | 6/1990 | European Pat. Off. . | |
| 2642854 | 4/1977 | Fed. Rep. of Germany | 250/516.1 |
| 3261198 | 10/1988 | Japan | 250/516.1 |
| 0841497 | 7/1960 | United Kingdom | 250/516.1 |

*Primary Examiner*—Jack I. Berman

*Assistant Examiner*—Jim Beyer

*Attorney, Agent, or Firm*—John F. A. Earley; John F. A. Earley, III

[57] ABSTRACT

An article for protection of gonadal areas, of a human body, against radiation, is disclosed. The article comprises (a) an elongated sheet of fabric material with a first end and a second end and having a width of 10-30 cm; (b) at least two complementary fastener means; and (c) a layer of flexible radiation protection material with a width of 10-30 cm and extending longitudinally from the second end towards the first end. One of the fastener means is located juxtaposed to the first end and the other is spaced apart from the first end, and the sheet of fabric is adapted to fold back on itself and be held in the folded position by the fastener means, thereby forming means to secure the article around the waist of a human body. The layer of radiation protective material has energy attenuation properties at least equivalent to 0.1 mm of lead at 100 keV, and is of a length such that when the fold is located at waist level on a human body the layer extends from above to below the gonadal area. The sheet of fabric material and the layer of flexible radiation protection material are attached circumferentially on three sides so as to form a pouch. The article is intended for use in the protection of the gonadal regions of the human body e.g. of operators of x-ray or other radiation emitting sources.

6 Claims, 4 Drawing Sheets

CLOTHING FOR PROTECTION OF GONADAL REGION

BACKGROUND OF THE INVENTION

1. Field of the Invention

The present invention relates to radiation protective articles of clothing, also referred to as an energy absorptive articles of clothing, and especially to a flexible light weight material that is in the form of an article of clothing and intended for use in attenuation of electromagnetic radiation, particularly in the gonadal region of a human body. In normal use, the article would be used in conjunction with other articles of clothing that are also intended for protection against electromagnetic radiation.

2. Description of the Related Art

Exposure of humans to energy from a wide variety of sources is increasing e.g. to energy in the form of sound or electromagnetic radiation including x-rays or alpha, beta or gamma radiation. It has been appreciated for a long time that radiation is harmful to the human body, especially to the chest, abdominal and reproductive or gonadal portions of the body. Articles of clothing intended to protect the human body from such radiation include aprons, vests, skirts and many other forms of apparel. For example, U.S. Pat. No. 3 996 620 of G. J. Maine, issued 1976 Dec. 14, describes an apron panel intended to cover the front of the body from neck to at least the knees and U.S. Pat. No. 4 196 355, also of G. J. Maine, issued 1980 Apr. 01, describes a two-piece radiation shield garment in the form of a vest and skirt.

Radiation protection materials have traditionally been based on lead, usually metallic lead, as the agent that provides protection against radiation. Lead is a dense material and a significant amount is required in order to provide material with adequate attenuation properties. Thus, articles of clothing intended for use in attenuation of electromagnetic radiation have a tendency to be heavy, which tends to discourage use by an operator of equipment that emits electromagnetic radiation.

Efforts have been made to reduce the weight of the protective material while at the same time providing equivalent attenuation properties. For example, published European Patent application No. 0 371 699 of M. J. Lilley, J. M. MacLeod, G. P. Reh, G. E. Mawdsley and M. J. Yaffe, published 1990 Jun. 06, describes radiation protection material that is lighter in weight than the traditional lead or lead vinyl materials while providing equivalent protection. Nonetheless, it would be of interest to potential users of radiation protection material to further decrease the weight of articles of clothing that are required to provide adequate protection.

A gonadal radiation protection article has now been found which provides additional protection in the gonadal area of a human body.

Accordingly, the present invention provides an article for protection of gonadal areas, of a human body, against radiation, comprising:

(a) an elongated sheet of fabric material with a first end and a second end and having a width of 10–30 cm;

(b) at least two complementary fastener means, one of which is located juxtaposed to the first end and the other being spaced apart from the first end, said sheet of fabric being adapted to fold back on itself and be held in the folded position by the fastener means, thereby forming means to secure the article around the waist of a human body; and (c) a layer of flexible radiation protection material with a width of 10–30 cm and extending longitudinally from the second end towards the first end, said layer having energy attenuation properties at least equivalent to 0.1 mm lead at 100 keV, said layer being of a length such that when the fold is located at waist level on a human body the layer extends from above to below the gonadal area, the sheet of fabric material and the layer of flexible radiation protection material being attached circumferentially on three sides so as to form a pouch.

In an embodiment of the article of the invention, the fastener means are snaps or Velcro® strips.

In another embodiment, the width of the layer of flexible radiation protection material is not greater than the width of the elongated sheet of fabric material.

BRIEF DESCRIPTION OF THE DRAWINGS

The present invention will be described with reference to the embodiments shown in the drawings in which.

DETAILED DESCRIPTION OF THE DRAWINGS

Figure 1:
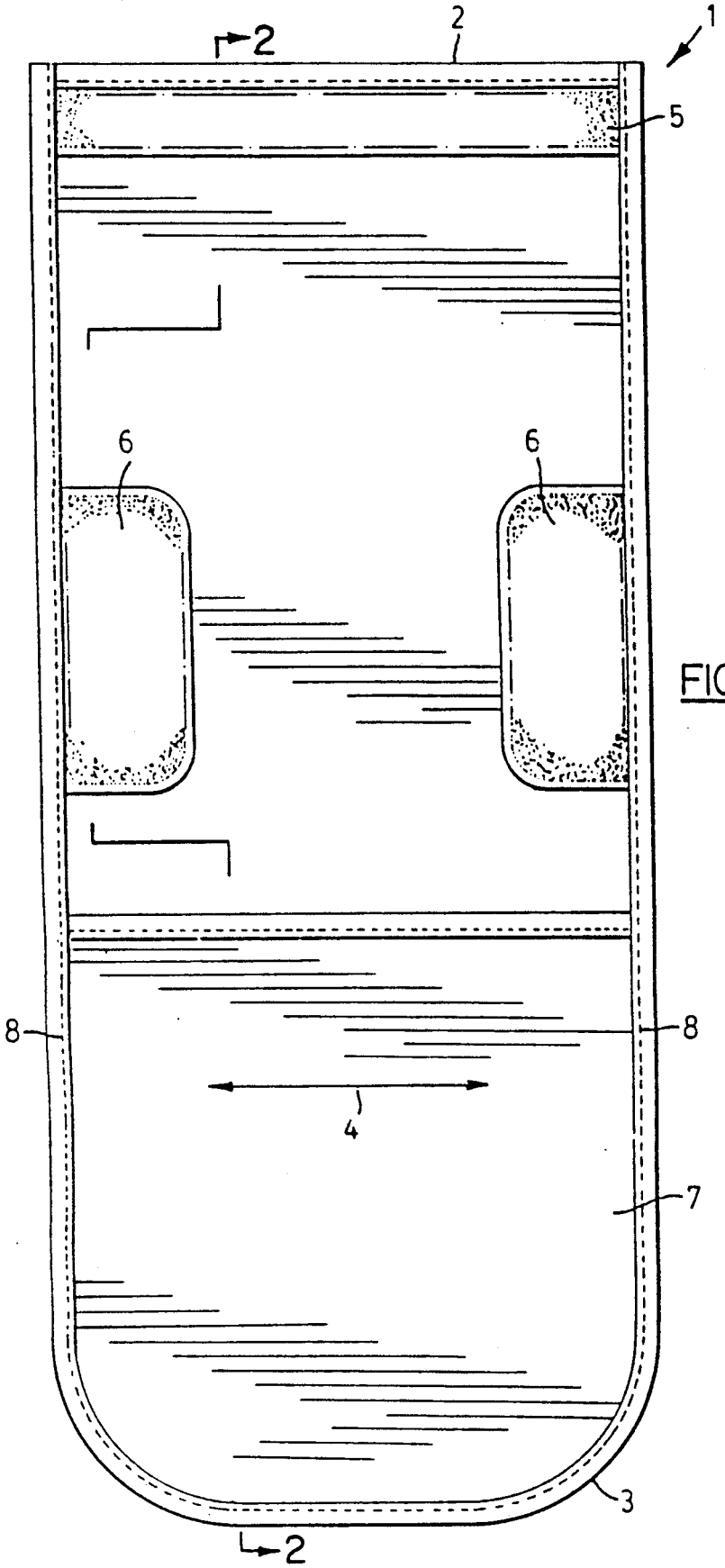
FIG. 1 is a plan view of an article of the invention.

FIG. 1 shows a gonadal protection article generally indicated by 1. The article has a first end 2 and a second end 3. The article is shown as elongated and having a width 4; width 4 is at least 15 cm and preferably at least 20 cm. While article 1 is shown as being elongated and substantially rectangular in shape, it is to be understood that it could be elongated but having a shape resembling a battle or be U-shaped near first end 2.

First end 2 is shown as having fastener means 5 juxtaposed to that end; the fastener means illustrated in FIG. 1 are Velcro fasteners. Fastener means 5 is shown as extending across the width of the first end 2, but in embodiments could be comprised of two or more portions of a fastener means. Complementary fastener means 6, located away from first end 2, are shown as being elongated in the longitudinal direction of the article and spaced apart from first end 2. It is intended that fastener means 5 and fastener means 6 be complementary. As will be apparent from FIG. 1, the elongated nature of fastener means 6 permits flexibility e.g. vertical adjustability, in the location of the fold formed when first end 2 is folded over.

Article 1 is shown as having a layer of protection material 7 extending from second end 3 towards first end 2. Protection material 7 is attached to the fabric of article 1 by means of stitching 8 which extends around three sides of protection material 7; as illustrated, stitching 8 extends along both sides of article 1 and across second end 2, thereby forming a pouch or pocket (referred to herein as a pouch). Although protection material 7 and the fabric of article 1 are conveniently attached by means of stitching, other means of attachment e.g. by bonding, may be used.

Figure 2:
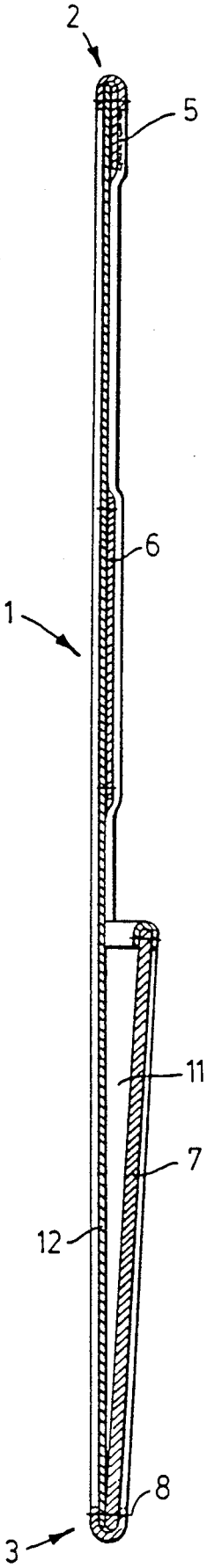
FIG. 2 is a cross-section of the article of FIG. 1 through 2—2.

FIG. 2 shows a cross-section of the article of FIG. 1. The article 1 is shown as having fastener means 5 juxtaposed to end 2 and fastener means 6 spaced apart from end 2. Protection layer 7 is shown as extending longitudinally from second end 3 towards first end 2. Protection layer 7 is attached to the fabric by means of stitching 8.

Figure 3:
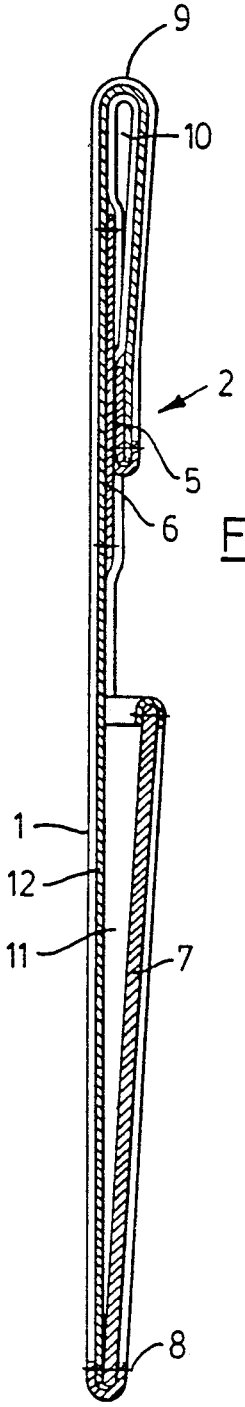
FIG. 3 is a cross-section of an article of FIG. 1 showing the first end folded back on itself.

FIG. 3 is similar to FIG. 2 except that the first end 2 is shown as being folded back so that fastener means 5 is attached to fastener means 6. This forms a fold 9 in the fabric of article 1, and provides a loop 10 to facilitate wearing of the article by a person e.g. to attach article 1 to a belt or a tie cord worn around the waist of a human body.

In the articles shown in FIG. 2 and FIG. 3, pouch 11 is formed between fabric 12 and protection material 7.

Figure 4:
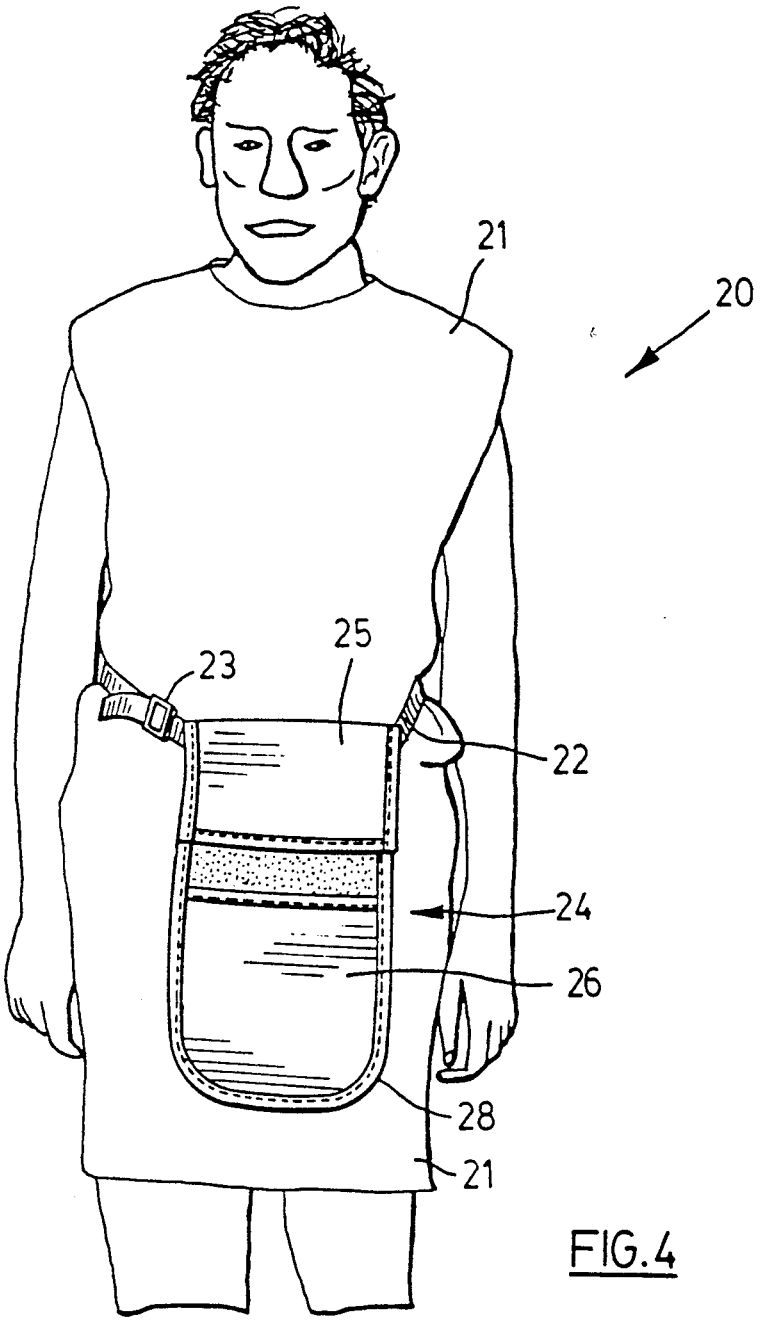
FIG. 4 is a schematic representation of use of an article of the invention.

FIG. 4 shows a person wearing radiation protection apparel, generally indicated by 20. In the embodiment shown, the apparel is in the form of an apron 21, although vest and skirts or other types of radiation protection apparel may be worn. Apron 21 is shown as having a belt 22 around the waist of the person, with belt buckle 23. An article of the present invention generally indicated by 24 is attached to the belt, by means of looped fabric 25. Looped fabric 25 is part of the fabric 28 that hangs down in front of the gonadal region of the person. A pouch 26, formed from radiation protective material, is attached to the front of fabric 28.

The layer of flexible radiation protection material has a width of 10–30 cm, especially at least 15 cm, and preferably at least 20 cm. In addition, the layer has energy attenuation properties at least equivalent to 0.1 mm lead at 100 keV, and preferably at least equivalent to 0.2 mm of lead at 100 keV.

The article of the present invention provides protection to the gonadal region of a human body, and in preferred embodiments is relatively light in weight, especially made of a material that is lighter in weight than conventional lead/vinyl. The article is especially intended for use with other radiation protection apparel. In such use the article of the invention permits use of lighter weight apparel with lower protection ratings over large portions of the body while providing important, additional, protection in the gonadal region, the article of the present invention specifically providing the latter. The article may be conveniently located on the human body so as to provide protection for gonadal areas, including being movable circumferentially around the body depending on the location of the source of radiation. The articles have fastener means for adjusting the height and location of the article on the wearer, so that it may be placed directly over the gonadal area to provide protection over the complete area of the gonads. Such height adjustment would normally be provided to accommodate most shapes and heights or humans, and not require custom fitting.

In preferred embodiments, articles of the invention are of different shapes and areas for males and females, in view of the different size and location of human male and female gonads. As used herein, female gonads are intended to include ovaries, fallopian tubes, uterus and vagina; thus, the articles may be used by females during pregnancy in the protection of a fetus in its early stages of development.

The article offers the convenience of a pouch formed as part of the article without addition of additional material. The pouch may be useful for the holding of pens, pencils, notebooks and the like, especially items particular to health care workers. The pouch may have a zipper or other fastening means.

The material of the fabric layer may be, for example, a vinyl material, a nylon or polyester fabric. The important requirement is that the material be capable of being folded back on itself and having sufficient strength to support the weight of the article when it is suspended on the belt of a human body. The fasteners must be of sufficient strength to maintain the article in place. The material of the protective layer may be that disclosed in the aforementioned published patent application of M. J. Lilley, J. M. MacLeod, G. P. Reh, G. E. Mawdsley and M. J. Yaffe.

In particular, said patent application, European Patent Application No. 0 371 669, states:

An energy absorption material, especially in the form of apparel, is disclosed. The material comprises a layer of a polymer composition formed from 7–30% by weight of a specified polar polymer, 0–15% by weight of a plasticizer and 70–93% by weight of an inorganic composition. The inorganic composition is formed from at least two elements as defined, or compounds thereof, which attenuate a range of energy. The materials provide superior protection against radiation than lead, in the degree of protection and/or the weight of the material required to provide the protection. The material may be used, in particular, for protection against x-rays, especially in the form of apparel e.g. for operators of x-ray equipment.

The present invention relates to energy absorptive material, also referred to as radiation protection material, especially to a flexible, lightweight material intended for use in attenuation of electromagnetic radiation, and in particular to such material in the form of an article of clothing.

Exposure of humans to energy from a wide variety of sources is increasing. The energy may be in the form of sound or electromagnetic radiation, including x-rays or alpha, beta or gamma radiation. Such exposure may be deliberate, for example, in the x-raying of a patient or treatment of a patient with radiotherapy or other radiation emitting devices, but exposure to radiation may also be an occupational hazard e.g. to the operators of x-ray or other radiation emitting materials or equipment. Many steps are taken to protect workers from exposure to radiation, including the extreme step of completely separating the operator from the energy or radiation source. However, on many occasions such separation is impractical or even impossible. For instance, it may be beneficial to have an operator in the vicinity of equipment that emits radiation to facilitate operation of the equipment. This is especially so during treatment or diagnosis of a patient using radiation, in order to facilitate operation of the equipment and/or to shield a patient from radiation except in those areas where the radiation is desired.

Individual energy absorbing elements have been proposed for use in attenuation of or protection against electromagnetic radiation. The element is normally selected to reduce or prevent penetration by the highest quantum level of energy in the spectrum, usually in the shortest wavelength or highest keV band. Typical methods involve the use of sheet metal, especially metallic lead or lead compounds; lead and its compounds are frequently used for protection against x-rays and beta and gamma radiation. Lead has the advantage of being readily available at low cost and it has a high density and a high atomic number, and is thus a compact absorber of medium to high energy radiation.

In embodiments, the lead or compounds of lead are finely dispersed in a matrix e.g. an inert, rigid or flexible, polymeric or elastomeric material. For instance, japanese patent application No. 58-053928 of K. Yamamoto, published Mar. 30, 1983, discloses an elastic (rubber) foam material containing large quantities of metal constituents e.g. lead oxide; the use of barium ferrite/nickel ferrite and barium ferrite/magnesium ferrite in such material for protection against magnetic effects is also disclosed. The powdered metal constituents are used in an amount, on a weight basis, that is greater than that of the base rubber material and are distributed uniformly throughout the base material. The preferred rubber material is polychloroprene rubber, and in the examples the compositions contain 80–87.3% by weight of the above metal constituents. The compositions contain minor amounts (<0.5%) of rubber processing aids e.g. magnesium oxide, zinc oxide and lead stearate.

Japanese patent application No. 57-141430 of K. Yamamoto, published Sep. 01, 1982, discloses a leaded foam material comprising a foamed material having as its base a natural or synthetic rubber consisting of a mixture of rubber having a molecular weight averaging 20,000 rubber having a molecular weight ranging from 2,000 to 12,000. The lead compounds are added to the base material in a proportion of 300 or more parts by weight of lead compound to 100 parts by weight of the base material and are uniformly distributed throughout the foamed material. The publication refers to organic and inorganic lead compounds, and exemplifies lead oxide in amounts of 80–87.3% by weight. The preferred rubber material is polychloroprene rubber, and the compositions contain minor amounts (<0.5%) of rubber processing aids e.g. magnesium oxide, zinc oxide and lead stearate.

Canadian Patent 815 609 of J. D. McCluer et al issued Jun. 17, 1969, discloses a flexible material comprising a fabric base and a lead-loaded elastomeric layer adhering to at least one surface of the fabric base. The layer has lead particles of a size smaller that 200 mesh (i.e. average particle size about 100 microns) dispersed throughout; the lead constituting at least 65% by weight of the total weight of the material. The lead-loaded elastomeric layer has a thickness of at least 125 mils (0.31 mm) and constitutes at least 68% by weight of the total weight of the material. The preferred elastomeric material is neoprene (polychloroprene).

Japanese patent application 61 228 051 of Dainichi Nippon Cables, published Oct. 11, 1986, discloses compositions of ethylene/vinyl acetate and/or ethylene/ethyl acrylate copolymers that contain 5–50 parts of anitmony oxide and 5–100 parts of barium sulphate, per 100 parts of polymer, as a wire coating compositions. Cross linking of the coated wire with electrons is also disclosed.

U.S. Pat. No. 4,563,494 discloses a polymer composition formed from at least one lanthanide oxide or hydroxide in an amount of 0.001 to 10% by weight of the composition, organic salts or complexes and a polymer containing e.g. acrylic or methacrylic acid or ester units, for use as a shield against neutron radiation.

U.K. Patents 1 603 654 and 1 603 655 granted Nov. 25, 1981, disclose compositions of metallic lead in polyvinyl chloride as an x-ray absorption material.

Japanese Kokai 59 126 296 of S. Madao et al, published Jul. 20, 1984, relates to a laminated composition for shielding against radiation, formed from lead or lead compound in a copolymer resin laminated to plasticized polyvinyl chloride. The copolymer may contain roll releasing agents, blocking inhibiting agents and the like, while the polyvinyl chloride is exemplified as containing tin maleate and magnesium oxide.

U.K. 1 122 766 of S. Sedlak, published Aug. 7, 1968, discloses a flexible radiation shielding material comprising an elastomeric matrix having filler particles distributed throughout the matrix. The filler is formed from an alloy of an ionization absorbing metal and at least one other metal. The latter is intended to overcome effects of lead compounds e.g. oxides and carbonates, that tend to be naturally present in small amounts in or on metallic lead, for instance as a result of atmospheric pollution, and which act as accelerators for various types of rubber latices; in some instances the same or related compounds are added to rubber latices to promote, catalyse or stabilize reactions e.g. cross-linking or vulcanizing of the rubber. Lead/tin and lead/antimony alloys are disclosed as overcoming such effects.

U.K. 954,593 of Gentex Corporation, published Apr. 08, 1964, discloses shielding against ionizing radiation that is in the form of lead coated fabrics that have been dipped into mercury, thereby forming a lead amalgam, to impart flexibility to the coated fabric.

Heavy, thick sound insulation using specific low cost barium salts to replace lead compounds is disclosed in Chinese patent application 8600457 of Liu et al. The addition of 100–3000 parts by weight of a metal, metal oxide, metal salts or fillers e.g. iron oxide, ferrite, lead oxide, tin oxide, barium or lead sulphate, barium or lead carbonate, to bituminous or bituminous/rubber compositions is disclosed in Japanese patent application 60 079 065 of Ube Industries, published May 4, 1985. Sound insulating sheet may be obtained by the coating iron foil with tin/lead, as is disclosed in Japanese patent application 60 026 651 of Riken KK, published Feb. 09, 1985.

Radiation attenuation materials in the form of mixtures of two or more elements or compounds thereof are disclosed in the patent application of M. J. Lilley, G. E. Mawdsley, G. P. Reh and M. J. Yaffe filed concurrently herewith. Highly filled compositions of metal compounds in polymers for use in attenuation of energy are disclosed in the patent application of M. J. Lilley, J. M. MacLead and R. H. Servant which is also filed concurrently herewith.

Unless specified to the contrary, all amounts of components of compositions or layers specified herein are on a weight basis, calculated on the amount of primary element e.g. if the compound was barium oxide, then the amount of component would be calculated on the basis of the amount of barium.

A material formed from a layer of a thermoplastic polymer and containing metallic compounds, which tends to be a lighter weight than other energy absorption materials, has now been found.

Accordingly, the present invention provides an energy attenuation material comprised of a layer of a polymer composition consisting essentially of:

(a) 7–30% by weight of a thermoplastic polymer selected from copolymers of ethylene with at least one of vinyl alkylate, alkyl acrylate, alkyl methacrylate, glycidyl methacrylate, acrylic acid, methacrylic acid and carbon monoxide, and mixtures thereof, ionomers of such copolymers, and such copolymers that have been grafted with a monomer selected from the group consisting of ethylenically unsaturated carboxylic acids and anhydrides and other derivatives thereof;

(b) 0–15% by weight of a plasticizer for such copolymers, and (c) 70–93% by weight of an inorganic composition consisting essentially of at least two elements, or compounds thereof, selected from the group consisting of actinium, antimony, barium, bismuth, bromine, cadmium, cerium, cesium, gold, iodine, indium, iridium, lanthanum, lead, mercury, molybdenum, osmium, platinum, pollonium, rhenium, rhodium, silver, strontium, tantalum, tellurium, thallium, thorium, tin, tungsten, uranium and zirconium, each element being in an amount of at least 5% by weight of the inorganic composition, said elements being selected to have complementary absorption characteristics in at least a selected portion of the electromagnetic radiation spectrum having energies in the range of 10–200 keV; said material attenuating electromagnetic radiation having energies of greater than 10 keV to an extent that is equivalent to a layer of metallic lead having a thickness of at least 0.10 mm.

In preferred embodiments of the invention, the inorganic composition has at least two different elements selected such that at least one element is selected from the group consisting of:

(A) actinium, bismuth, gold, lead, mercury, polonium, thallium, thorium and uranium;

(B) bismuth, gold, lead, mercury and thallium;

(C) iridium, osmium, platinum, rhenium, tantalum and tungsten; and (D) bromine, molybdenum, rhodium, strontium and zirconium; and at least one element is selected from the group consisting of:

(E) barium, cerium, cesium, iodine and lanthanum; and (F) antimony, cadmium, indium, silver, tellurium and tin, or, the inorganic composition has at least two different elements selected such that at least one element is selected from group (A) above and at least one element is selected from the group consisting of (B), (C), (E) and (F) above.

In another embodiment, the material comprises at least two layers, one of said layers being comprised of a flexible fabric and the other of said layers being the layer of the polymer composition.

In a preferred embodiment of the material of the present invention, the polymer composition has a density in the range of 2.8 to 6.5 g/cm$^2$.

In a further embodiment, the polymer composition has a flexural modulus in the range of 1 to 100 MPa.

The present invention provides a radiation protection or attenuation material comprising a layer of a polymer composition. In embodiments, the material is comprised of at least two layers, one layer of flexible fabric and one layer of the polymer composition. Such flexible fabric may be selected from a wide variety of materials. In preferred embodiments, the flexible fabric is a woven or knitted nylon (polyamide) material, but other knitted or woven materials may be used e.g. polyesters. The nature of the flexible fabric material may be varied over a wide range, as the primary purpose of the fabric is to provide any or all of the following: abrasion resistance, tensile strength, tear strength, water absorption, flexibility, drape and feel properties to the radiation protection material. The fabric may be adhered to the polymer composition or loosely attached thereto e.g. by stitching or seam welding. The fabric may be on one or both sides of the layer of the composition; as noted above and in embodiments in which the radiation protection material is not intended to be part of a person's apparel, the fabric may be omitted in its entirety.

The layer of the polymer composition is comprised of a polymer component and an inorganic component. The polymer is selected from copolymers of ethylene with at least one of vinyl alkylate, alkyl acrylate, alkyl methacrylate, glycidyl methacrylate, acrylic acid, methacrylic acid and carbon monoxide, and mixtures thereof. The polymer may also be an ionomer of such copolymers, especially in ionomer in which the metallic ion is sodium, zinc or aluminum. In addition, the polymer may be such a copolymer that has been grafted with a monomer selected from the group consisting of ethylenically unsaturated carboxylic acids and anhydrides and other derivatives thereof. Examples of such polymers include ethylene/vinyl acetate copolymers, ethylene/methyl acrylate copolymers, ethylene/methyl methacrylate copolymers, ethylene/acrylic acid copolymers, ethylene/methacrylic acid copolymers, ethylene/alkyl acrylate/glycidyl methacrylate copolymers, ethylene/n-butyl acrylate/carbon monoxide copolymers, ethylene/vinyl acetate/carbon monoxide copolymers and related polymers, and sodium and zinc ionomers e.g. of ethylene/acrylic acid and methacrylic acid copolymers. As used herein, it is understood that copolymers may have more than two monomers i.e. include polymers sometimes referred to as terpolymers. The grafted polymers include such copolymers that have been grafted with maleic acid or maleic anhydride. In addition, the polymers may be cross-linked, subsequent to polymerization, with ionizing radiation or cross-linking agents in order to modify the properties of the Polymer. Many examples of such polymers are available commercially e.g. from DuPont Canada Inc., and/or the techniques for the fabrication and/or modification of such polymers are known in the art. In embodiments of the invention, the thermoplastic polymer of the composition may additionally include polyvinyl chloride polymers. The properties of the radiation protection material may depend on both the type and physical parameters of the thermoplastic polymer e.g. some polymers may tend to interact with the inorganic component and result in materials of higher stiffness than if other polymers or inorganic components were used. In preferred embodiments, the density of the polymer is less than 1.1 and preferably less than 1.0 g/cm$^3$.

The composition may also contain a primary or secondary plasticizer or plasticizer extender for the copolymer of the composition, as is known in the art. Any such plasticizer must be compatible with the copolymer, and be of a type and used in an amount that does not result in bleeding or blooming of the plasticizer from the resultant composition. Moreover, the plasticizer must be compatible with the metallic compounds added as part of the composition. In preferred embodiments, the plasticizer also has as density of less than 1.1, especially less than 1.0 g/cm$^3$. Examples of such plasticizers include aromatic processing oils e.g. Sunthene (denotes trade mark) 4240 plasticizer, trioctyl trimellitate, diisononyl phthalate and dioctyl phthalate. Other examples include other phthalate esters, phosphate esters, fatty acid esters, adipates, azelates, oleates, sebacates and sulfonamides.

The composition contains 7–30% by weight of the copolymer and 0–15% by weight of plasticizer. In preferred embodiments, the composition contains 7–12% by weight of copolymer and 5–10% by weight of plasticizer. However, the combined amount of copolymer and plasticizer is less than 30% by weight and particularly less than 60% by volume of the composition, and especially less than 20% by weight and less than 55% by volume of the composition.

The composition used to form the layer also contains an inorganic component. The inorganic component may be in the form of metals per se, or alloys or compounds of such metals. The compounds may be in the form of oxides, carbonates, sulphates, halides especially fluorides and iodides, hydroxides, tungstates, carbiides, sulphides, uranates and tellurides or metallic salts of organic acids e.g. acetates, stearates, naphthenates, benzoates, formates, propionates, and other organotin and organolead compounds. The inorganic component should be compatible with the copolymer component of the composition, although there may be physical or chemical interactions between the components that enhance the properties of the resultant composition. The metals or metallic compounds are used in a finely divided form and are uniformly dispersed throughout the thermoplastic polymer. For instance, the particle size should be less than 100 mesh (screened to an average of less than 150 microns particle size) and in particular have an average of about 200 mesh (screened to greater than 60 microns).

The inorganic component of the polymer composition has at least two energy absorbing elements, or compounds thereof, that are intended to provide protection against radiation of at least two different wavelengths, especially in the form of a spectrum of radiation. The combination of elements, or compounds thereof, forming the inorganic composition will especially depend on the particular spectrum against which protection is required, and particular the distribution of wavelengths in that spectrum.

As an illustration, if the spectrum is a typical spectrum in the range of 10–60 keV, a preferred inorganic composition comprises at least one element or compound thereof selected from groups (A), (C) and (D) above with the remainder being at least one element or compound thereof selected from groups (E) or (F), especially 20–70 parts and in particular 30–50 parts from groups (A), (C) and (D), per 100 parts of the inorganic composition, on an element basis. Alternatively, if the spectrum is a typical spectrum in the range of 20–150 keV, a preferred inorganic composition comprises at least one element or compound thereof selected from group (A) above with the remainder being at least one different element or compound thereof selected from groups (B), (C), (E) or (F), especially 50–85 parts and in particular 60–80 parts from group (A), per 100 parts of the inorganic composition, on an element basis. For spectra containing radiation above 150 keV, pollonium, actinium, thorium or urganium may be combined with another different element from groups (A), (B) or (C). Similarly, for radiation having energies below 40 keV, an element from group (F) may be combined with an element from groups (A), (C) and (D).

In preferred embodiments of the invention, the inorganic composition is formed from at least three elements, or compound thereof. For example, for a spectrum having radiation predominantly in the range of 10–60 keV, at least one element may be selected from groups (A), (C) and (D), one element from group (E) with the remainder being selected from group (F); preferred amounts of the elements are 20–50 parts per 100 parts of the protective layer, on an element basis. Similarly, for radiation predominantly in the range of 20–150 keV, at least one element may be selected from group (A), at least one different element from groups (B) and (C), with the remainder selected from groups (E) and (F); preferred amounts are 20–50 parts per 100 parts of the inorganic composition, on an element basis.

Figure 5:
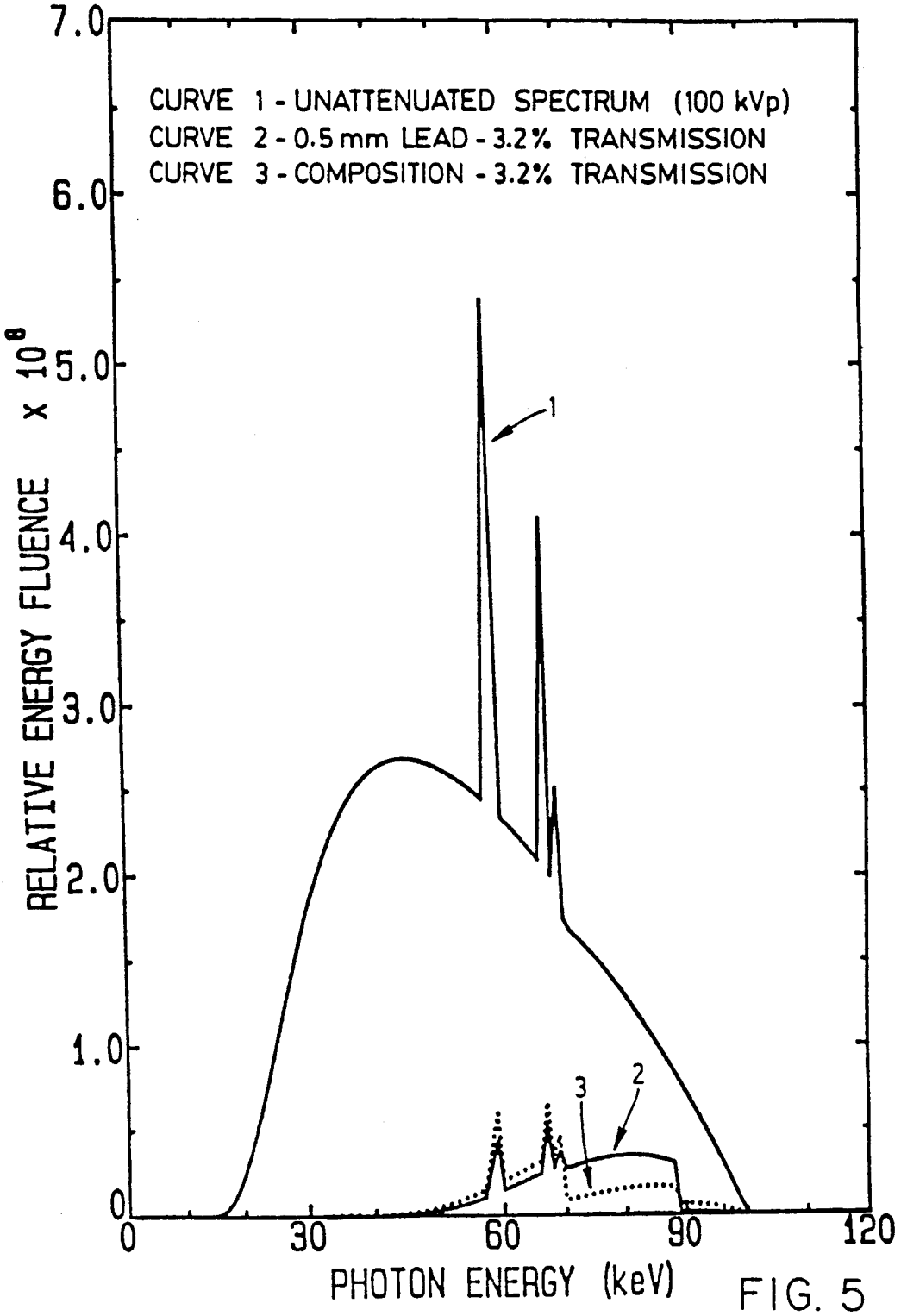
FIG. 5 shows energy fluence spectra.

By suitable selection of the combinations of the elements or compounds, including selection of the proportions of the elements, it is possible to control not only the amount of radiation that is attenuated but also the shape of the spectrum of the radiation that is transmitted through the material i.e. the shape of the radiation spectrum remaining after fractional attenuation and which passes through the protective layer. Both the shape of the photon spectrum and the so-called energy fluence spectrum i.e. the spectrum formed by taking into account the relative energies of the transmitted radiation, are important. An illustration of a comparison of the attenuation achieved by lead and by a lead/barium tungstate (1:2 on a weight basis) composition is shown in FIG. 1 (of European Patent Application 0 371 699, and FIG. 5 of this case), which is a computer generated plot of an energy fluence spectra. FIG. 1 (of European Patent Application 0 371 699, and FIG. 5 of this case) shows the spectral curve for the unattenuated or source radiation (Curve 1) as well as the spectral curve as attenuated by a layer of lead (Curve 2) and by a layer of the lead/barium tungstate composition (Curve 3); Curves 2 and 3 represent 3.2% transmission of energy. It will be noted that although both the lead and lead/barium tungstate composition result in a substantial amount of attenuation of the radiation, the lead/barium tungstate composition exhibits substantially higher attenuation of radiation in the 70–90 keV range; that range is most often encountered with respect to protection of operators of x-ray equipment.

It has been found that elements may be combined in both type and proportions such that (a) the mass of elements or compounds required to absorb a predetermined fraction of the radiation from a given source may be reduced by up to 40% by weight compared to a single element e.g. lead, or (b) for the same mass of elements, or compounds thereof, the amount of radiation absorbed is substantially higher than for a single element e.g. by up to 150% of the so-called "lead equivalency". Such properties are particularly important in the field of radiation shielding and protective apparel where better protection or the same protection at least weight of the apparel offers important benefits to the user in terms of protection and/or comfort.

In preferred embodiments of the invention, the elements are antimony, barium, bismuth, bromine, cadmium, gold, iodine, lanthanum, lead, mercury molybdenum, rhenium, silver, strontium, tantalum, tellurium, tin, tungsten, uranium and zirconium.

The composition used to form the layer comprises 70–93% by weight of the metallic compounds and especially 80–90% by weight of metallic compounds.

The polymer composition used to form the layer may contain antioxidants, UV and other stabilizers and pigments, as will be appreciated by those skilled in the art.

The layer of inorganic material is used in a thickness that provides a protection against electromagnetic radiation having energies of greater than 0.1 keV, that is the equivalent of a layer of metallic lead having a thickness of at least 0.10 mm, especially at least 0.25 mm and in particular at least 0.5 mm. Such equivalency is measured in the manner for determination of lead equivalency known in the art, using x-rays having a spectrum energy of, typically, a maximum of 100 kV, as described in Example I. In more general terms, equivalence is determined by measuring the broad area transmission of radiation of a sample of material for a radiation beam of known energy. The transmission is then measured in the same manner for a set of samples of commercially-pure lead of different known thicknesses, and the equivalence for the test sample is obtained by interpolation. Such equivalence only applies to the energy spectrum used in the test measurements. For diagnostic x-ray protection, a typical energy spectrum is obtained when a potential of 100 kVp (Kilovolts Peak) is applied to an x-ray tube. Transmission is defined as the ratio of the exposure (coulombs/kg-air) measured in an ionization chamber with material in the beam to the corresponding exposure obtained without material in the beam.

The nature of the radiation protection material of the present invention is such that the material of the present invention will provide superior protection of attenuation than lead, per unit mass of element, against radiation having energies of greater than 0.1 keV e.g. providing protection equivalent to 0.5 mm of lead with less mass of element or better protection at the same mass of element. The improved attenuation applies to a specific energy (wavelength) spectrum, and may be optimized for each individual energy spectrum. The radiation protection material of the invention attenuates radiation and provides protection over a broader range of energies of the electromagnetic spectrum than does metallic lead, lead compounds or other single element absorbers.

In preferred embodiments, the polymer composition has a density in the range of 2.8 to 6.5 g/cm$^3$, and especially in the range of 3.0 to 5.0 g/cm$^3$. Density of the composition is important in that a lightweight material that has effective absorbance characteristics to x-rays is more useful and practical material than materials of lower density; in particular, it can provide less bulk (volume) and consequently thinner materials which have more flexibility. Lead sheet is an effective radiation protection material with respect to x-rays but it lacks the other characteristics needed to make it a practical material for use as apparel or in packaging.

In further preferred embodiments, the composition has a flexural modulus, at 23° C. in the range of 1 to 100 MPa, especially in the range of 5 to 15, and in particular in the range 7 to 12, MPa. Flexural modulus is measured by the procedure of ASTM D-790. The flexural modulus of the composition is important in order to provided apparel that is practical for wearing or which is capable of being used as a shielding material.

If the material protection material is to be used as apparel, it requires an acceptable strength, flexibility, drape and feel. Such terms are understood in the art of fabrics and related industries, and relate to the way in which the fabric conforms to a human body and to the manner in which the material feels when touched or is in contact with the skin.

The compositions of the present invention may be obtained by feeding the ingredients to melt compounding or similar equipment, the actual equipment depending in part on the actual composition to be prepared and the melt processing characteristics of that composition; pressurized equipment is not required. Examples of compounding equipment include two-roll mills, Banbury mixers, Farrell (denotes trade mark) continuous mixers, Buss (denotes trade mark) co-kneaders, Gelimat (denotes trade mark) high intensity mixers and the like. Compositions of high content of inorganic component and/or containing grafted polymers may be more difficult to process so as to obtain uniform compositions, and may require the use of high intensity mixers or the like. For instance, compositions of the invention may be compounded using a Banbury twin rotor internal mixer by addition of all of the ingredients into the mixer. It may, however, be preferable to prepare concentrates of plasticizer and/or the metallic compounds in polymer, and then compound the combinations of the concentrates in a high shear mixer; such as of concentrates may be less hazardous to operators of the equipment. The composition may be formed into sheet by extrusion, calendering, compression moulding or the like, a preferred method being by calendering. The layer(s) of fabric may be adhered to the composition simultaneously with the formation of the layer of the composition or in a separate step e.g. using a lamination technique; lamination may be achieved using heat and/or adhesives or utilizing adhesive properties of the polymer used in forming the composition.

In the preparation of the materials of the invention, the selection of compatible inorganic components, polymers and plasticizers, the surface characteristics, friability and the particle size distribution of the inorganic component, the densities of all components, the volume ratio of polymer to filler and the method of addition and mixing of the components of the composition may all affect the properties of the layer of material. For example, one polymer filled with 505 by volume of an inorganic composition may be stiff whereas another polymer with the same amount of inorganic composition may be relatively flexible. Also, if the polymer has high wetting properties and affinity for the inorganic components, addition of the plasticizer to the mixer used in the preparation of the polymer composition as the last component may result in exclusion of the plasticizer from or incompatibility of the plasticizer in the composition.

In embodiments, the present invention may be used in the form of apparel to protect the wearer from radiation, especially electromagnetic radiation and in particular x-ray radiation. The apparel may be in the form of full garments or in the form of vests or the like to protect portions of the human body. The radiation protection material may also be used in other end-uses e.g. for attenuation of radiation associated with the use of apparatus that emits or is sensitive to the presence of radiation.

The present invention is illustrated by the following examples:

EXAMPLE I

The following compositions were prepared:

| Component | Composition* A | Composition* B |
|---|---|---|
| Polymer** | | |
| I | 5.70 | 9.18 |
| II | 2.87 | — |
| Plasticizer*** | 6.43 | 5.82 |
| Filler | | |
| PbO | 23.38 | 23.38 |
| $WO_3$ | 21.25 | 21.25 |
| $BaF_2$ | 40.38 | 40.38 |

-continued

| Component | Composition* A | Composition* B |
|---|---|---|
| Density (g/cm$^3$) | 3.39 | 3.39 |

*amounts are in wt. %
**Polymer I was an ethylene/vinyl acetate copolymer having a vinyl acetate content of 36% and a melt index of 0.8 dg/min. Polymer II was an ethylene/vinyl acetate copolymer having a vinyl acetate content of 33% and a melt index of 25 dg/min. that had been melt grafted with about 1.2% by weight of maleic anhydride.
***The plasticizer was an aromatic processing oil, available as Sunthene 4240 processing oil from Sunoco Inc. of Toronto, Ontario, Canada.

Compositions A and B were formed by blending the components in a Brabender Plasticorder (denotes trademark) twin rotor mixer at 170° C. Sheets of the compounded composition were then formed by compression moulding, the sheets having a thickness of 1.59 mm.

Absorbance to x-rays was measured by the following procedure: Exposure rate was measured using a calibrated ionization chamber at a position 100 cm from a tungsten target x-ray tube collimated to provide a beam measuring 8 cm×8 cm. The tube was powered by a constant-potential x-ray generator providing 100 kV at 10 mA with a resultant half-value layer (HVL) of 5.0 mm aluminum. Variation in output was less than 0.5%/hour. Samples of the composition and of lead of known thickness were placed in the beam, 15 cm above the ionization chamber to determine the relative transmissions, and the lead equivalence for the composition was obtained by interpolation.

The materials obtained above had an absorbance to x-rays equivalent to 0.58 mm of lead. It was found that the weight equivalent required to provide the absorption exhibited by 0.5 mm of lead was 5.35 kg/m$^2$ for both materials. This represents a weight saving, compared to lead, of 36% but a weight saving compared to so-called "lead-vinyl" having 80% lead in 20% polyvinyl chloride (w/w), which weighs 7.3 kg/m$^2$, of 27%.

EXAMPLE II

The following composition was prepared:

| Component | Composition* C |
|---|---|
| Polymer** | |
| I | 5.70 |
| II | 2.87 |
| Plasticizer*** | 6.43 |
| Filler | |
| PbO | 46.75 |
| $BaWO_4$ | 38.25 |

*amounts are in wt. %
**Polymer I was an ethylene/vinyl acetate copolymer having a vinyl acetate content of 36% and a melt index of 0.8 dg/min. Polymer II was a ethylene/vinyl acetate copolymer having a vinyl acetate content of 33% and a melt index of 25 dg/min. that had been melt grafted with about 1.2% by weight of maleic anhydride.
***The plasticizer was an aromatic processing oil. available as Sunthene 4240 processing oil from Sunoco Inc. of Toronto, Ontario. Canada.

Composition C was formed by blending the components in a Banbury twin rotor high intensity mixer by feeding the components of the composition to the mixer. The composition obtained was formed into sheets using a calendering process at a processing temperature of about 50°-55° C., the sheet having a thickness if 0.81 mm. The sheet was laminated to nylon fabric using the adhesive properties of the polymer mixture at elevated temperature.

Absorbance to x-rays was measured by the procedure of Example I. It was found that for absorption equivalent to 0.5 mm of lead, the composition weighed 5.73 kg/m$^2$. The elemental weight saving compared to 0.5 mm of lead was 21% and the sample weight saving compared to lead/vinyl was also 21%.

Additional tests were carried out using the procedure of Example I for the measurement of absorption to x-rays but at 60 kVp, 80 kVp, 100 kVp and 120 kVp and the lead equivalence was determined. At 100 kVp, the sheet tested was equivalent to 1.12 mm of lead; the corresponding results at 60 kVp, 80 kVp and 120 kVp were 0.10 mm, 0.10 mm and 0.12 mm.

EXAMPLE III

The following composition, having a density of 3.49 g/cm$^3$, was prepared:

| Component | Composition D */ |
|---|---|
| Polymer** | |
| III | 10.0 |
| IV | 3.0 |
| Plasticizer*** | 7.0 |
| Filler | |
| Pb metal | 20.4 |
| $WO_3$ | 21.6 |
| $BaF_2$ | 38.0 |

*amounts are in wt. %
**Polymer III was a blend of stabilized polyvinyl chloride with an ethylene/butyl acrylate/carbon monoxide copolymer. Polymer IV was an ethylene/vinyl acetate/-carbon monoxide copolymer having a melt index of about 35 dg/min.
***The plasticizer was trioctyl trimellitate.

The composition was formed by blending the components in a Brabender Plasticorder twin rotor mixer at 170° C. A sheet having a thickness of 1.59 mm was then formed by compression moulding the composition. The resultant sheet had an absorbance to x-rays equivalent to 0.5 mm of lead, as determined by the procedure of Example I, and showed a decrease in flexibility on aging.

EXAMPLE IV

The following composition was prepared, the amounts being on a weight basis:

| | |
|---|---|
| Lead oxide (PbO) | 48.2% |
| Barium tungstate | 39.4% |
| Copolymer | 9.3% |
| Plasticizer | 3.1% |

The copolymer was a blend of Polymers I and II of Example I, in the same ratio, and the plasticizer was Suthene 4240 aromatic processing oil. The composition had a density of 3.85 g/cm$^3$.

Films of the composition were subjected to x-rays and the absorption characteristics of the composition were determined using the procedure of Example I. It was found that the weight equivalent required to provide the absorption exhibited by 0.5 mm of lead was 5.54 kg/m$^2$. This represents a weight saving compared to lead, of 2% but a weight saving compared to so-called "lead-vinyl" of 24%.

EXAMPLE V

The following compositions were prepared, and tested for absorbance of x-rays using the procedure of Example I:

| Run No. | 1 | 2 | 3 |
|---|---|---|---|
| PbO (wt. %) | 27 | 40 | 48 |
| SnO (wt. %) | 26.5 | 20 | 16 |
| $BaSO_4$ (wt. %) | 26.5 | 20 | 16 |
| Carrier* (wt. %) | 20 | 20 | 20 |
| Elements in Inorganic Component (wt. %) | 80 | 83 | 85 |
| Composition Density | 3.0 | 3.1 | 3.2 |
| Lead Equivalence (mm) | 0.38 | 0.40 | 0.41 |
| Weight Saving** | 22 | 17 | 14 |

*ethylene/vinyl acetate copolymer, unplasticized
**reduction in weight of sample, elemental basis, compared to lead to give same absorption as 0.5 mm of lead at 100 kVp.

EXAMPLE VI

A composition of PbO (29.75% by weight) and barium oxide (55.25% by weight) in an ethylene/vinyl acetate copolymer (15% by weight) was prepared using the procedure of Example III. X-ray absorption was measured, for 100 kVp, using the procedure of Example I.

It was found that for absorption equivalent to 0.5 mm of lead, the composition weighed 5.9 kg/m$^2$, or 4.54 kg/m$^2$ based on the amount of absorbing elements only.

EXAMPLE VII

A composition of PbO (22% by weight), tungsten trioxide powder (20% by weight) and barium fluoride (38% by weight) in an ethylene/vinyl acetate copolymer (17% by weight) containing 3% by weight of dioctyl phthalate was prepared using the procedure of Example III. The composition obtained had a density of 3.36 g/cm$^3$. The composition contained 80% by weight of inorganic component and had a flexural modulus of 27.6 MPa.

It was found that for absorption equivalent to 0.5 mm of lead, the composition weighed 5.83 kg/m$^2$, or 3.85 kg/m$^2$ based on the amount of absorbing elements only. The elemental weight saving compared to 0.5 mm of lead was 32% and the sample weight saving compared to lead/vinyl was 20%.

EXAMPLE VIII

A composition was prepared of lead tungstate (46.75% by weight) and barium fluoride (38.25% by weight) in an unplasticized ethylene/vinyl acetate copolymer (15% by weight). The composition was made by the method of Example III. The x-ray absorption was measured using the procedure of Example I.

It was found that for absorption equivalent to 0.5 mm of lead, the composition weighed 5.9 kg/m$^2$, or 4.31 kg/m$^2$ based on the amount of absorbing elements only. The elemental weight saving compared to 0.5 mm of lead was 24% and the sample weight saving compared to lead/vinyl was 19%.

This Example illustrates a composition that does not contain a plasticizer.

EXAMPLE IX

A composition of metallic lead (21.675% by weight), tungsten trioxide (22.95% by weight) and barium fluoride (40.375% by weight) was prepared in Polymer III of Example III (7.50% by weight) and Polymer IV of Example III (3.75% by weight). The composition also contained 3.75% by weight of trioctyl trimellitate. The polymer composition obtained had 85% by weight of inorganic component and a density of 3.70 g/cm$^3$. X-ray absorption was measured using the procedure of Example I.

It was found that for absorption equivalent to 0.5 mm of lead, the composition weighed 5.38 kg/m$^2$, or 3.91 kg/m$^2$ based on the amount of absorbing elements only. The elemental weight saving compared to 0.5 mm of lead was 31% and the sample weight saving compared to lead/vinyl was 26%.

EXAMPLE X

A composition of barium tungstate (84% by weight) was prepared in a blend of ethylene/vinyl acetate copolymers (9.5% by weight) and Sunthene 4240 processing oil as plasticizer (6.5% by weight) using the procedure of Example III. The polymer composition obtained had a density of 3.0 g/cm$^3$. X-ray absorption was measured using the procedure of Example I.

It was found that for absorption equivalent to 0.5 mm of lead, the sample weighed 5.51 kg/m$^2$. The elemental weight saving compared to 0.5 mm of lead was 29% and the sample weight saving compared to lead/vinyl was 24%.

The sample of the polymer composition was in the form of sheet having a weight of 4.47 kg/m$^2$. The X-ray absorption was also measured using the procedure of example I but at 60 kVp, 80 kVp, 100 kVp and 120 kVp and the lead equivalence was determined. At 100 kVp, the sheet was equivalent to 0.39 mm of lead; the corresponding results at 60 kVp, 80 kVp and 120 kVp were 0.27 mm, 0.31 mm and 0.35 mm.

EXAMPLE XI

A composition of metallic lead (32.2% by weight), metallic tin (27.6% by weight) and metallic tungsten (32.3% by weight) was prepared in an ethylene/vinyl acetate copolymer (7.9% by weight) using the method of Example III; thus, the composition contained 92.1% by weight of inorganic components. The polymer composition obtained had a density of 6.03 g/cm$^3$.

Computer analysis indicated that the sample would provide an elemental weight saving compared to lead of 26% and a sample weight saving compared to lead/vinyl of 38%.

EXAMPLE XII

A composition of lead powder (9.0% by weight), a powdered lead/tin (50:50) alloy (35.8% by weight) and barium tungstate (44.6% by weight) in a blend of ethylene/vinyl acetate copolymers (6.3% by weight) and Sunthene 4240 aromatic processing oil (4.3% by weight) was prepared using the method of Example III; thus, the composition contained 89.4% by weight of inorganic component. The polymer composition obtained had a density of 4.02 g/cm$^3$. X-ray absorption was measured using the procedure of Example I.

It was found that for absorption equivalent to 0.5 mm of lead, the sample weighed 4.6 kg/m$^2$. The elemental weight saving compared to 0.5 mm of lead was 29% by weight and the sample weight saving compared to lead/vinyl was 37% by weight.

EXAMPLE XIII

A composition of metallic lead powder (33.5% by weight) and barium tungstate (51.1% by weight) was prepared in a blend of ethylene/vinyl acetate copolymers (8.8% by weight) and Sunthene 4240 processing oil as plasticizer (6.6% by weight) using the procedure of Example II. The polymer composition obtained had a density of 3.40 g/cm$^3$, and had an inorganic component content of 84.6% (w/w) and 45% (v/v). X-ray absorption was measured using the procedure of Example I.

It was found that for absorption equivalent to 0.5 mm of lead, the sample weighed 5.82 kg/m$^2$. The elemental weight saving compared to 0.5 mm of lead was 23% and the sample weight saving compared to lead/vinyl was 20%.

The sample of the polymer composition was in the form of sheet having a weight of 5.56 kg/m$^2$. The X-ray absorption was also measured using the procedure of Example I but at 60 kVp, 80 kVp, 100 kVp and 120 kVp and the lead equivalence was determined. At 100 kVp, the sheet was equivalent to 0.48 mm of lead; the corresponding results at 60 kVp, 80 kVp and 120 kVp were 0.39 mm, 0.44 mm and 0.45 mm.

In an embodiment of the present invention, an article of clothing was formed from a polyester knit fabric that was coated with polyvinyl chloride. The fabric had a width of 20.8 cm and a total length of 49 cm. The fabric had Velcro fasteners located as a continuous strip across the width of the fabric at one end. In addition, there were two strips of Velcro ® fabric commencing 14 cm from the end and extending away a further 10 cm, with a width of 4.5; these strips were located at opposite edges of the fabric. The corners away from the fastening means were rounded. A pouch was formed by attaching to the polyester fabric, a laminate of radiation protection material of the type disclosed in the aforementioned European patent application, bonded to a woven polyamide fabric; the radiation protection material had a lead equivalency of 0.25 mm at 100 keV. The pouch was the same shape as the polyester fabric, and extended for 20.5 cm from the lower end i.e. the end opposite the fastening means, towards the end with the fastening means. The pouch was attached to the polyester fabric by stitching on both sides and across the lower end. The article was wipable with a wet cloth.

Other similar articles of the invention have been fabricated in greater widths and with the entire lower portion of the article rounded. Different widths were fabricated because the minimal width required for gonadal protection of males and females is different.

We claim:

1. An article for protection of gonadal areas, of a human body, against radiation, comprising:

(a) an elongated sheet of fabric material with a first end and a second end and having a width of 10–30 cm;

(b) at least two complementary fastener means, one of which is located juxtaposed to the first end and the other being spaced apart from the first end, said sheet of fabric being adapted to fold back on itself and be held in the folded position by the fastener means, thereby forming means to secure the article around the waist of a human body; and (c) a layer of flexible radiation protection material with a width of 10–30 cm and extending longitudinally from the second end towards the first end, said layer having energy attenuation properties at least equivalent to 0.1 mm of lead at 100 keV, said layer being of a length such that when the fold is located at waist level on a human body the layer extends from above to below the gonadal area, the sheet of fabric material and the layer of flexible radiation protection material being attached circumferentially on three sides so as to form a pouch.

2. The article of claim 1 in which the fastener means are snaps or Velcro ® strips.

3. The article of claim 1 when adapted to be attached to the human body by means of a belt or tie cord.

4. The article of claim 1 in which the width of the layer of flexible radiation protection material is not greater than the width of the elongated sheet of fabric material.

5. The article of claim 4 in which the width of the layer of flexible radiation protection material is at least 15 cm.

6. The article of claim 5 in which the width of the layer of flexible radiation protection material is at least 20 cm.

* * * * *